US007722140B2

(12) United States Patent
Huang et al.

(10) Patent No.: US 7,722,140 B2
(45) Date of Patent: May 25, 2010

(54) SLIDE RAIL

(75) Inventors: Kuo-Ming Huang, Taipei Hsien (TW); Mo-Ming Yu, Shenzhen (CN); Hai-Chen Zhou, Shenzhen (CN)

(73) Assignees: Hong Fu Jin Precision (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 158 days.

(21) Appl. No.: 11/947,774

(22) Filed: Nov. 30, 2007

(65) Prior Publication Data

US 2008/0143226 A1 Jun. 19, 2008

(30) Foreign Application Priority Data

Dec. 14, 2006 (CN) ..... 2006 1 0201301

(51) Int. Cl.
*A47B 88/00* (2006.01)

(52) U.S. Cl. ..... 312/334.8

(58) Field of Classification Search ..... 312/334.16, 312/334.1, 334.4, 334.7, 334.8, 350; 384/20, 384/23

See application file for complete search history.

(56) References Cited

U.S. PATENT DOCUMENTS

| | | | | | |
|---|---|---|---|---|---|
| 3,092,429 | A | * | 6/1963 | Barnes | 312/333 |
| 3,133,768 | A | * | 5/1964 | Klakovich | 384/17 |
| 5,403,097 | A | * | 4/1995 | Woof | 384/20 |
| 6,145,945 | A | * | 11/2000 | Parvin | 312/334.46 |

FOREIGN PATENT DOCUMENTS

| | | | |
|---|---|---|---|
| CN | 2058572 | U | 6/1990 |
| JP | 10179293 | A | 7/1998 |

* cited by examiner

*Primary Examiner*—Janet M Wilkens
*Assistant Examiner*—Matthew W Ing
(74) *Attorney, Agent, or Firm*—Frank R. Niranjan

(57) ABSTRACT

A slide rail includes a first slide and a second slide. The first slide provides a first arced surface. The second slide provides a second arced surface for being engaged with the first arced surface, so that the second slide is slidable relative to the first slide. The second arced surface has a same curvature as that of the first arced surface.

11 Claims, 3 Drawing Sheets

SLIDE RAIL

BACKGROUND

1. Field of the Invention

The present invention generally relates to slide rails. Particularly, the present invention relates to slide rails without ball bearings.

2. Description of Related Art

Slide rails are used for guiding objects, such as drawers, to be pushed into or pulled out from bodies, such as furniture. There are many kinds of slide rails, some have ball bearings and others do not. Slide rails having ball bearings are easy to be pulled or pushed, for they have little friction. However, the ball bearings add to the cost of the slide rails, and brackets for supporting the ball bearings tend to be broken, which causes the slide rail to become unusable.

Slide rails without ball bearings have lower costs than those having ball bearings. Such slide rails each has at least two slides movable relative to each other. The two slides contact each other in a line-contact mode. This kind of contact makes the slide rails unable to support heavy loads.

Therefore, a need exists in the industry to provide a low-cost slide rail which can support heavy loads.

SUMMARY

In one embodiment, a slide rail includes a first slide and a second slide. The first slide provides a first arced surface. The second slide provides a second arced surface for being engaged with the first arced surface, so that the second slide is slidable relative to the first slide. The second arced surface has a same curvature as that of the first arced surface.

Other advantages and novel features of the slide rail will become more apparent from the following detailed description of preferred embodiments when taken in conjunction with the accompanying drawings, in which:

DETAILED DESCRIPTION

Figure 1:
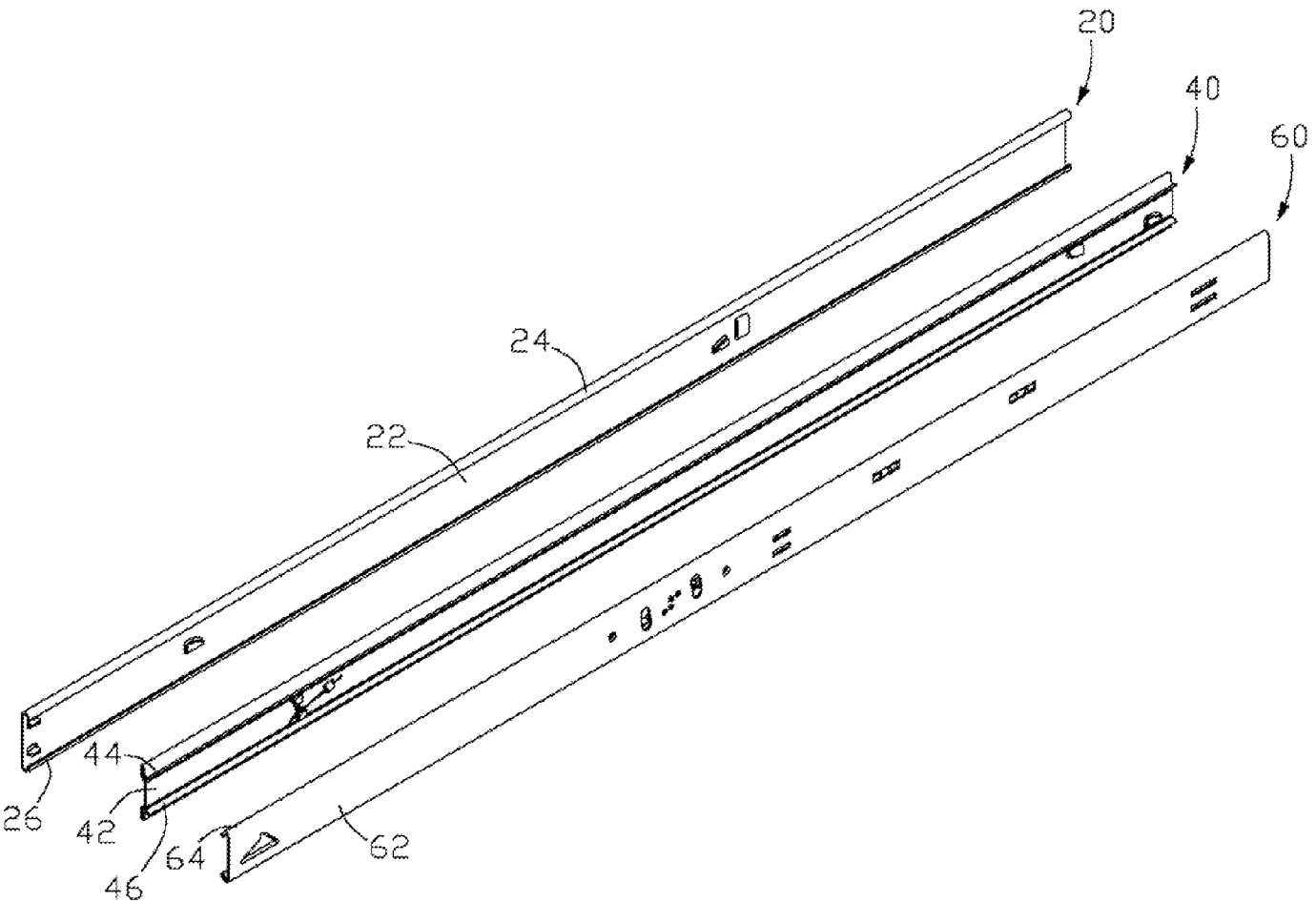
FIG. 1 is a perspective view of a slide rail in accordance with an exemplary embodiment of the present invention.
Figure 2:
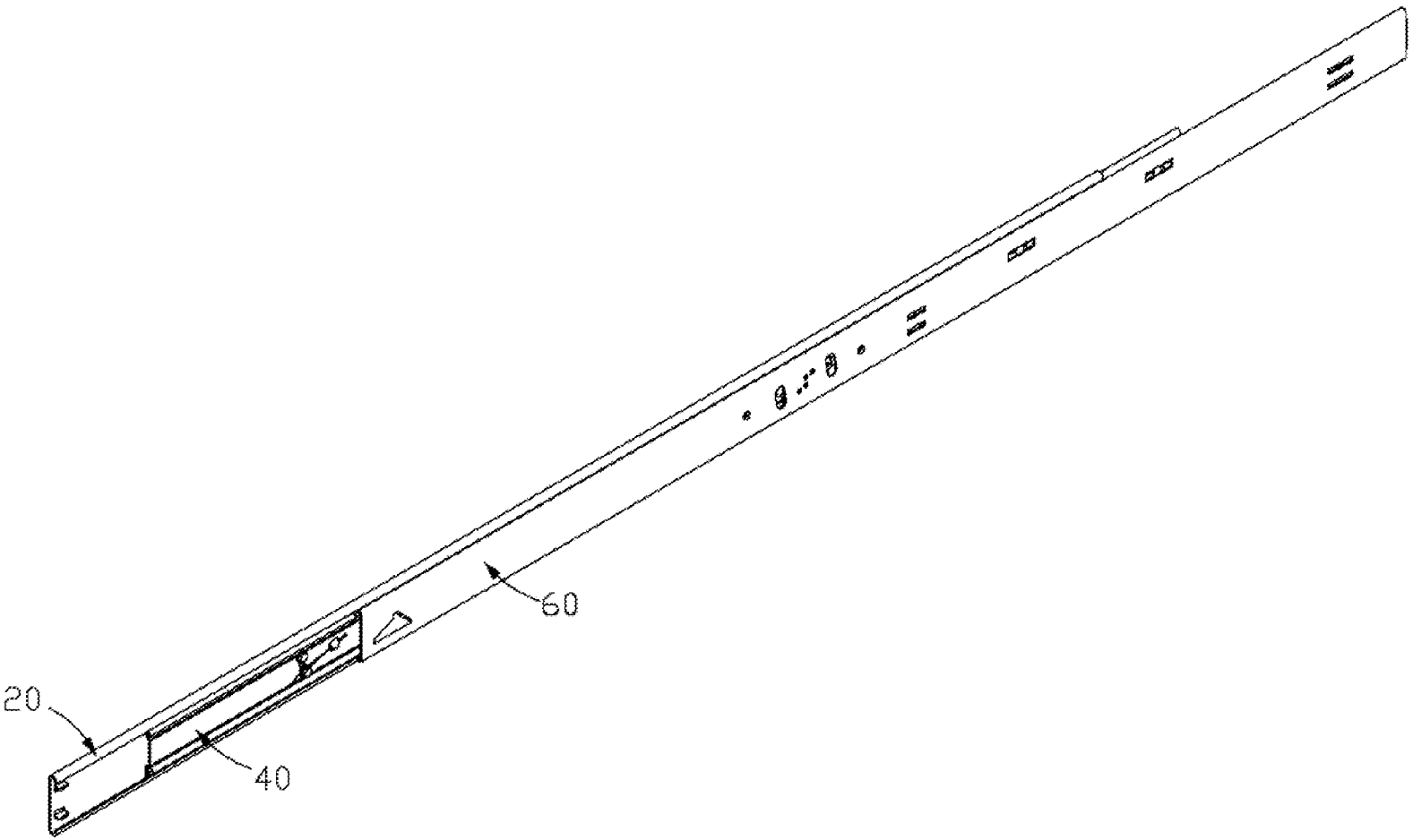
FIG. 2 is an assembled view of the slide rail of FIG. 1.

Referring to FIG. 1 and FIG. 2, a slide rail in accordance with an exemplary embodiment includes a first slide 20, a second slide 40, and a third slide 60. The first slide 20 is used for being fixed on a stable object, like a kind of furniture, or racks for servers. The third slide 60 can be fixed on a movable object, such as drawers of the furniture, or servers to be installed in the racks. The second slide 40 is received in the first slide 20, and installed between the first slide 20 and the third slide 60. The second slide 40 is movable relative to the first slide 20 and the third slide 60. Through the motion between the three slides, the movable object can be pushed into or pulled out from the stable object.

Figure 3:
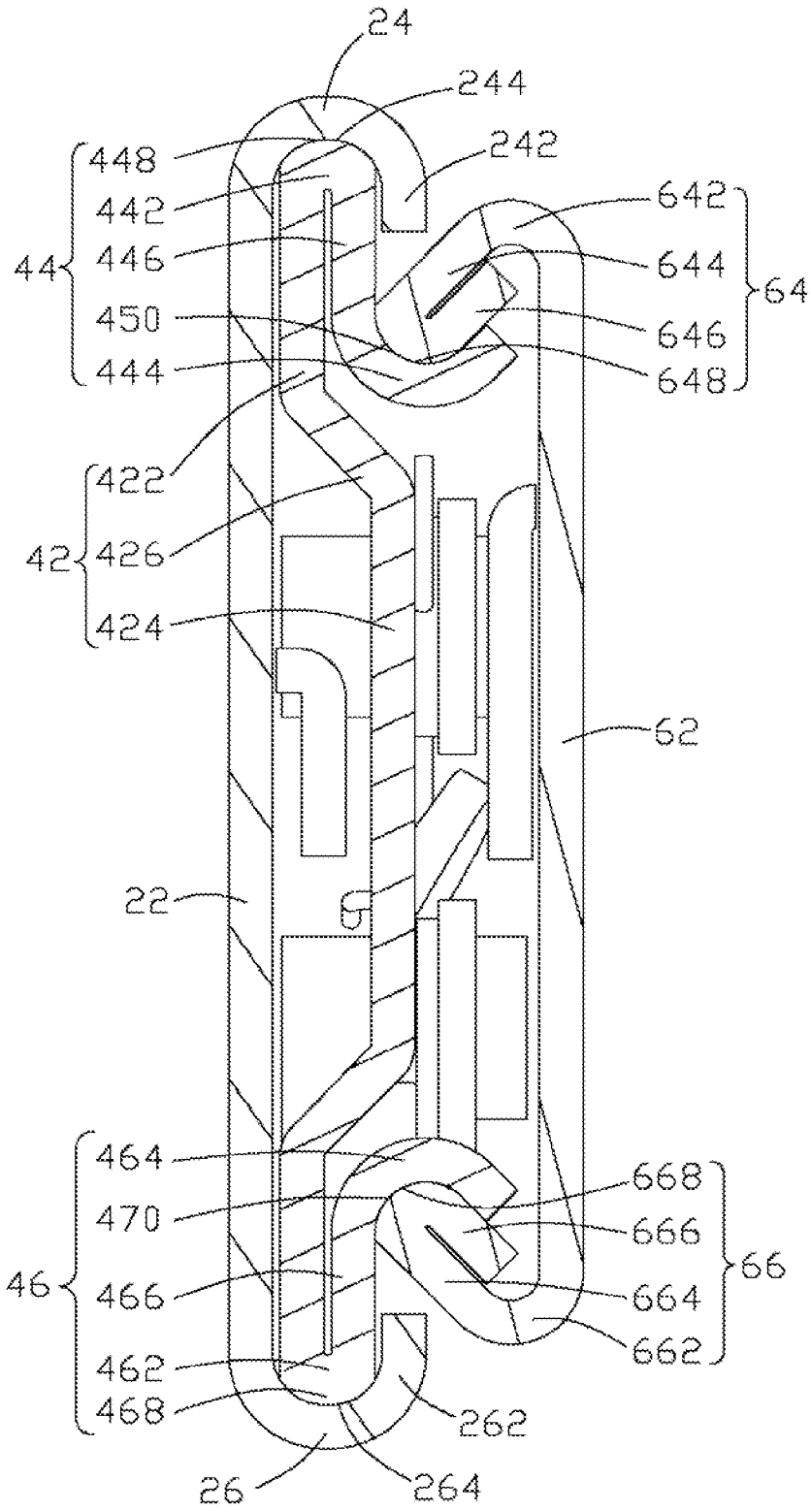
FIG. 3 is a cross-sectional view of the slide rail of FIG. 2.

Referring to FIG. 3, the first slide 20 includes a bottom wall 22 and a pair of sidewalls 24, 26. The bottom wall 22 extends in the longitudinal direction, along with the sidewalls 24 and 26. The two sidewalls 24 and 26 are extended from the bottom wall 22 at its two longitudinal sides, in an identical direction. Ends 242 and 262 of the two sidewalls 24 and 26 are respectively turned over to be generally parallel with the bottom wall 22. At an inner side of each of the sidewalls 24 and 26, first recesses 244, 264 are provided respectively.

The second slide 40 includes a main plate 42 and two side parts 44, 46. The two side parts 44 and 46 are symmetrically disposed on two sides of the main plate 42, integrally extending from the main plate 42.

The main plate 42 includes a pair of end portions 422, a flat panel 424, and a pair of connection portions 426. The end portions 422 are disposed on two side of the flat panel 424, and are parallel with the flat panel 424, which is parallel with the bottom wall 22 of the first slide 20 after assembled. The connection portions 426 connect the pair of end portions 422 and the flat panel 424 at two sides of the flat panel 424, respectively. The connection portions 426 are symmetrically inclined to the flat panel 424. After assembly, the end portions 422 are nearer the bottom wall 22 than the flat panel 424.

The side parts 44 and 46 have generally the same structure, so the side part 46 is mainly described in below description for simplicity. The side part 46 includes a first curve 462, a second curve 464, and a connection portion 466. The first curve 462 is extended from the end portion 422 of the main plate 42. The first curve 462 interconnects the end portion 422 and the connection portion 466, which is parallel with the end portion 422. A first camber 468 is provided on an outer surface of the first curve 462. The curvature of the first camber 468 is the same as the curvature of the first recess 264 of the first slide 20. The connection portion 466 is generally extended from the first curve 462 in a direction approaching the inclined connection portion 426 of the main plate 42. The second curve 464 extends from the connection portion 466 in a direction away from the connection portion 426 of the main plate 42. Accordingly, a second recess 470 is provided in an inner surface of the second curve 464.

Similarly, the side part 44 includes a first curve 442, a second curve 444, and a connection portion 446. The connection portion 446 interconnects the first curve 442 and the second curve 444. The first curve 442 provides a first camber 448 on the outer surface thereof, and the second curve 444 provides a second recess 450 on the inner surface thereof. Thus the connection portions 446, 466 of the side parts 44, 46 extend toward each other, and the extension ends of the second curves 444, 464 extend away from each other.

The third slide 60 includes an installation plate 62 and two arms 64, 66 symmetrically disposed on two sides of the installation plate 62 respectively. The installation plate 62 can be fixed to the movable object when in use, and is parallel with the bottom wall 22 of the first slide 20 after assembly. The arms 64 and 66 that have symmetrically the same structures are used for clamping the second slide 40 when assembled.

The arm 64 includes a bending portion 642, a clamp plate 644, and a free end 646. The bending portion 642 interconnects the installation plate 62 and the clamp plate 644. The bending portion 642 is set in such a manner that, the extension end of the clamp plate 644 other than its opposite end that is connected to the bending portion 642, points at the second curve 444, and is received in the second recess 450 of the second curve 444. The bending portion 642 guides the installation plate 62 to turn over from its edge to its central part.

The extension end of the clamp plate 644, other than its opposite end that is connected to the bending portion 642, is turned over to form the free end 646. The free end 646 is generally parallel with the clamp plate 644. At a cross that the clamp plate 644 meets the free end 646, a second camber 648 is provided. The second camber 648 has a same curvature as that of the second recess 450.

Similarly, the arm 66 includes a bending portion 662, a clamp plate 664, and a free end 666. A second camber 668 is also provided at the cross of the clamp plate 664 meets the free end 666. Thus, the clamp plates 644, 664 extend toward each other.

In assembly, the second slide 40 is received in the first slide 20, with the first cambers 448, 468 slidably engaging with the first recesses 244, 264, respectively. Thus, the second slide 40 and the first slide 20 contact each other at arced surfaces thereof. The third slide 60 is slidably sleeved over the second curves 444, 464 of the second slide 40, with the second cambers 648, 668 engaging with the second recesses 450, 470, respectively. Accordingly, the second slide 40 and the third slide 60 contact each other at arced surfaces thereof in other than in line-contact mode.

Some lubricant can be added on the contact surfaces of the slides, which can result in smooth movement during pushing and pulling of the slides, and facilitates use of the slide rail.

The slides of the slide rail contact each other at arced surfaces, which reduces the intensity of pressure applied on the slides. Accordingly, the slide rail is able to endure heavy loads. The arced contact surfaces can also be utilized in slide rails having only two slides, or four or more slides, as well.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A slide rail comprising:

a first slide comprising a longitudinal bottom wall and a pair of sidewalls extending from two longitudinal sides of the bottom wall; each of the pair of sidewalls providing a first arced surface on its inner side; and a second slide comprising a main plate and two side parts extending from two longitudinal sides of the main plate respectively; each of the two side parts comprising a first curve that provides a second arced surface on its outer side for being engaged with the first arced surface so that the second slide is slidable relative to the first slide, wherein the second arced surface has the same curvature as the first arced surface; each of the two side parts further comprising a second curve providing a fourth arced surface on its inner side, and a first connection portion connecting the first curve and the second curve; extension ends of the two second curves extending away from each other, thereby forming recesses in respective fourth arced surfaces of the second curves;

wherein the slide rail further comprises a third slide comprising two arms each providing a third arced surface on its outer side for being slidably contacting with the corresponding fourth arced surface of the second curve; and the two first connection portions extend toward each other, each of the arms of the third slide comprises a clamp plate, the two clamp plates extend toward each other, and extension ends of the two clamp plates are received in the corresponding recesses of the second curves;

the extension end of each of the clamp plates is turned over to form a free end, and the free ends are parallel with the corresponding clamp plates.

2. The slide rail as described in claim 1, wherein the two sidewalls are extended to turn over to a direction parallel with the bottom wall.

3. The slide rail as described in claim 1, wherein the main plate comprises a flat panel and a pair of end portions, the end portions being parallel with the flat panel.

4. The slide rail as described in claim 3, wherein the end portions are connected to two sides of the flat panel through a pair of second inclined connection portions.

5. The slide rail as described in claim 1, wherein the third arced surface has the same curvature as the fourth arced surface.

6. The slide rail as described in claim 1, wherein the third slide further comprises an installation plate and two bent portions connecting two edges of the installation plate and the clamp plates respectively.

7. A slide rail comprising:

a first slide comprising a longitudinal bottom wall and a pair of sidewalls extending from two longitudinal sides of the bottom wall, each of the pair of sidewalls providing a first arced surface on its inner side;

a second slide received in the first slide, the second slide comprising a main plate comprising a flat panel and two second connection portions symmetrically inclined to the flat panel, and two side parts extending from two sides of the main plate respectively; the main plate further comprising two end portions being connected to the two second connection portions respectively and parallel with the flat panel; each of the two side parts comprising a first curve being connected to the corresponding end portion and providing a second arced surface on its outer side for being in contact with the first arced surface so that the second slide is slidable relative to the first slide, a second curve providing a fourth arced surface on its inner side, and a first connection portion connecting the first curve and the second curve and extending toward the corresponding second connection portion; extension ends of the two second curves extend in a direction away from the corresponding second connection portions, thereby forming recesses in respective fourth arced surfaces of the second curves; and a third slide comprising two arms each providing a third arced surface on its outer side for being slidable along the corresponding fourth arced surface of the second curve; each of the arms of the third slide comprising a clamp plate; the two clamp plates extend toward each other; and extension ends of the two clamp plates are received in the corresponding recesses of the second curves;

wherein ends of the two sidewalls are folded back to be parallel with the bottom wall.

8. The slide rail as described in claim 7, wherein the extension end of each of the clamp plates is turned over to form a free end, and the free ends are parallel to the corresponding clamp plates.

9. The slide rail as described in claim 8, wherein the third slide further comprises an installation plate and two bent portions connecting two edges of the installation plate and the clamp plates respectively.

10. The slide rail as described in claim 7, wherein each of the second arced surfaces has the same curvature as the corresponding first arced surface.

11. The slide rail as described in claim 7, wherein each of the third arced surfaces has the same curvature as the corresponding fourth arced surface.

* * * * *